United States Patent [19]

Nishikawa et al.

[11] 4,143,344

[45] Mar. 6, 1979

[54] MICROWAVE BAND-PASS FILTER PROVIDED WITH DIELECTRIC RESONATOR

[75] Inventors: Toshio Nishikawa, Nagaokakyo; Youhei Ishikawa; Sadahiro Tamura, both of Kyoto, all of Japan

[73] Assignee: Murata Manufacturing Co., Ltd., Nagaokakyo, Japan

[21] Appl. No.: 805,572

[22] Filed: Jun. 10, 1977

[30] Foreign Application Priority Data

Jun. 14, 1976 [JP] Japan ..... 51-70260

[51] Int. Cl.[2] ..... H01P 1/20; H01P 7/06

[52] U.S. Cl. ..... 333/202; 333/219

[58] Field of Search ..... 333/8, 73 C, 73 R, 73 W, 333/73 S, 83 A, 83 T, 83 R, 98 R, 82

[56] References Cited

U.S. PATENT DOCUMENTS

| | | | |
|---|---|---|---|
| 3,353,122 | 11/1967 | Manoochehri | 333/73 W |
| 3,496,498 | 2/1970 | Kawahashi et al. | 333/98 |
| 4,028,652 | 6/1977 | Wakino et al. | 333/83 A |

*Primary Examiner*—Alfred E. Smith
*Assistant Examiner*—Harry E. Barlow
*Attorney, Agent, or Firm*—Wenderoth, Lind & Ponack

[57] ABSTRACT

A microwave band-pass filter has a casing, at least one dielectric resonator in the casing and at least one metallic adjusting screw supported by a wall of the casing and positioned adjacent the dielectric resonator with the tip end of the screw closely adjacent the resonator, so as to improve the sensitivity characteristics of the filter especially in the region higher than the resonance frequency.

8 Claims, 11 Drawing Figures

MICROWAVE BAND-PASS FILTER PROVIDED WITH DIELECTRIC RESONATOR

The present invention relates to a microwave band-pass filter and, more particularly, to an improved type of microwave band-pass filter provided with at least one dielectric resonator and at least one adjusting screw for adjusting the resonance characteristics of the filter in the region higher than the resonance frequency thereof, thus improving the sensitivity of the microwave band-pass filter.

It is well known that a microwave band-pass filter utilizes one or more resonators made of dielectric material for improving the quality factor Q of a dominant mode to be filtered. However, conventionally, in a filter employing a dielectric resonator, the sensitivity of the filtering effect, referred to as the sensitivity characteristic hereinbelow, is not symmetrical, that is, the wave shape of the sensitivity characteristic above the resonance frequency $f_0$ is different from that of the sensitivity characteristic below the resonance frequency $f_0$, as shown in FIG. 1 in which the abscissa and the ordinate represent frequency and attenuation, respectively. In most of the cases, the sensitivity characteristic in the region A which is below the resonance frequency $f_0$ has a comparatively rapid increase to the dominant mode, while, on the other hand, the sensitivity characteristic in the region B which is above the resonance frequency shows a slow fade-out of the dominant mode.

It has been found that such difference in the filtering effect between the regions A and B is caused by the variation of coupling coefficient between the neighboring resonators, or otherwise by the overlap of an undesirable mode appearing close to the resonance frequency $f_0$ in the region B with the dominant mode.

In order to eliminate such difference, one method is to construct the resonators of different material or in a different size from each other for matching the coupling coefficient. However, this method is comparatively difficult, since it takes much skill and time before obtaining a well balanced filter without any variation of coupling coefficient between the neighboring resonators.

Another method is to provide an auxiliary dielectric resonator adjacent the dielectric resonator for producing antiresonance in the region B for improving the wave shape of the sensitivity in the region B. However, this method is not only difficult to accomplish, but also involves a high manufacturing cost.

Accordingly, a primary object of the present invention is to provide an improved type of microwave band-pass filter which has a high sensitivity of the filtering effect in the region B in FIG. 1.

Another object of the present invention is to provide a microwave band-pass filter of the above described type in which the improvment of the filtering effect can be obtained with a simple construction and at a low cost.

The present invention is based on a fact that the positioning of a conductive material in a place where the electric field intensity is high, causes the resonance frequency $f_1$ of a particular mode producing said electric field to shift from $f_1$ to $f_1-\Delta f$. The amount of variation of the frequency $\Delta f$ is determined by the degree of intrusion of the conductive material into the electric field, that is, the greater the degree of the intrusion is, the larger the variation of the frequency $\Delta f$.

It has been found that the electric field of the dominant mode is not distributed around the side surface of the dielectric resonator to any great degree. However, on the other hand, the electric field of the spurious mode is concentrated around the side surface of the dielectric resonator.

Thre present invention takes advantage of the features of the electric field as described above. The microwave band-pass filter of the present invention comprises a casing, at least one dielectric resonator provided in the casing and at least one conductive material provided adjacent the side surface of the resonator where the electric field intensity is high. The conductive material may be an adjusting screw adjustably threaded through the casing, so that it is comparatively simple to adjust the positioning of the adjusting screw, by turning the same.

By providing the adjusting screw closely adjacent the dielectric resonator, the resonance frequency of a spurious mode can be shifted from $f_1$ to $f_1\Delta f$, which frequency $f_1-\Delta f$ is slightly smaller than the frequency $f_0$ of the dominant mode. Thus, the wave shape of the spurious mode overlaps that of the dominant mode, especially in the region A. More specifically, the spurious mode is shifted to the frequency $f_1-\Delta f$ which is slightly below the resonance frequency $f_0$. Accordingly, the shifted spurious mode causes the sensitivity characteristics of the dominant mode to drop more rapidly in the region B. In other words, the wave shape in the region B becomes more steep, and the wave shape in the region B becomes substantially symmetrical with that in the region A.

Therefore, in the microwave band-pass filter of the present invention, the employment of the adjusting screw improves the sensitivity characteristics so as to make the wave shape symmetrical and also improves the quality factor Q of the filter.

These and other objects and features of the present invention will become apparent from the following description of preferred embodiments with reference to the accompanying drawings in which, FIG. 1 is a graph showing the sensitivity characteristic of a conventional band-pass filter employing a dielectric resonator;

FIG. 3(*b*) is a sectional front view taken along the line III(*b*)–III(*b*) of FIG. 3(*a*);

Figure 2:
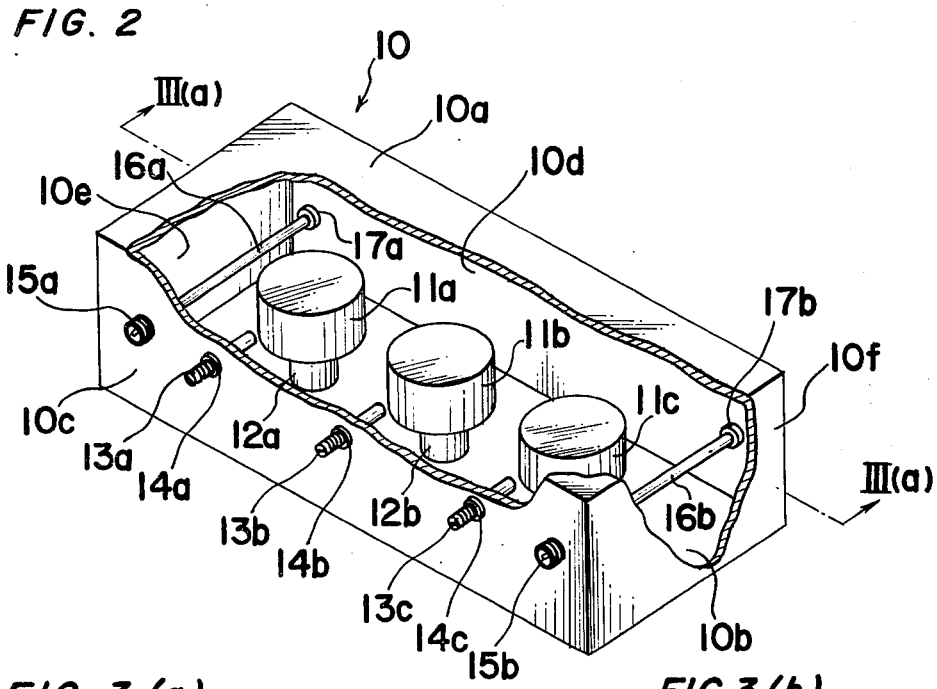
FIG. 2 is a perspective view, partly broken away, of a band-pass filter according to the present invention and showing the arrangement of adjusting screws in relation to the dielectric resonators employed therein.
Figure 4:
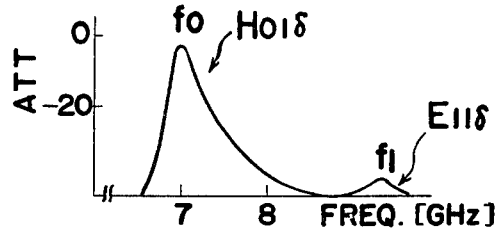
Figure 4:
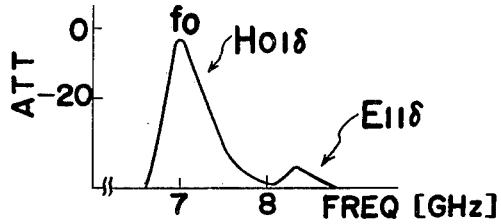
Figure 4:
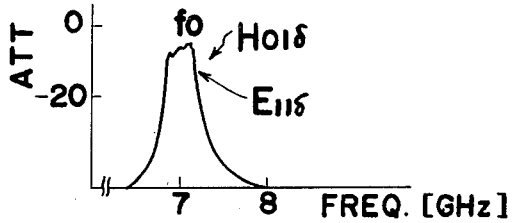
Figure 4:
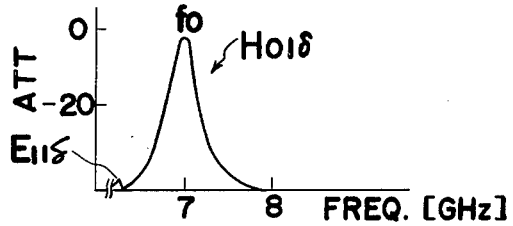
Figure 4:
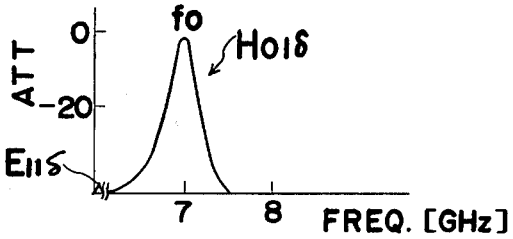
Figure 5:
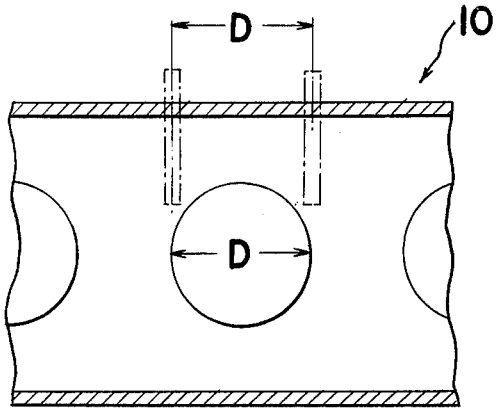
Figure 6:
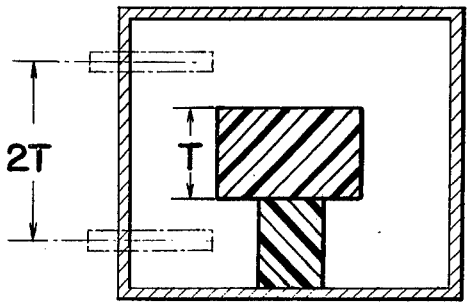

FIGS. 4(*a*) to 4(*e*) are graphs showing the manner in which the characteristic wave form of the spurious mode overlaps with the characteristic wave form of the dominant mode and the way in which the characteristic wave form of the dominant mode changes with respect to the shift of the characteristic wave form of the spurious mode;

FIG. 5 is a fragmentary top plan view of the microwave band-pass filter shown in FIG. 2, particularly showing a horizontal range within which the adjusting screw can be provided; and FIG. 6 is a sectional side view of the microwave band-pass filter shown in FIG. 2, particularly showing a vertical range within which the adjusting screw can be provided.

Before the description of the present invention proceeds, it should be noted that like parts are designated by like reference numerals throughout the accompanying drawings.

Referring first to FIG. 2, the microwave band-pass filter of the present invention comprises a casing 10 of substantially box-like configuration made of any known metallic material such as brass, which casing 10 includes top and bottom walls 10*a* and 10*b*, a pair of opposed side walls 10*c* and 10*d* and a pair of end walls 10*e* and 10*f*. Although the walls 10*a* to 10*f* are shown as integrally formed by machining from a rigid metal block, the walls may be formed by metallic sheets or plates with the neighboring walls being rigidly connected to each other, by the use of, for example, a plurality of screws.

Within the casing 10, one or more resonators, which are here shown as being in three in number and indicated by 11*a*, 11*b* and 11*c*, are mounted on the bottom wall 10*b* on respective supporting spacers 12*a*, 12*b* and 12*c* and arranged in a row in spaced and side-by-side relation with each other. The supporting spacers 12*a* to 12*c* are made of any known electrically insulating material having a relatively low dielectric constant.

One of the opposed side walls 10*c* is provided at respective portions adjacent to the opposed ends thereof with couplers 15*a* and 15*b* for respective connection with coaxial cables for microwave input and output transmission lines (not shown). These couplers 15*a* and 15*b* have axial terminals which are electrically insulated from the metal casing 10 and which are respectively connected with rods or probes 16*a* and 16*b* made of either electrically conductive material or dielectric material. The probes 16*a* and 16*b* in the instance as shown in FIG. 2 extend in parallel relation to the end walls 10*e* and 10*f* and are respectively positioned between the end wall 10*e* and the end resonator 11*a* and between the end wall 10*f* and the end resonator 11*c*. One of the ends of each of the probes 16*a* and 16*b*, which is remote from the corresponding coupler 15*a* or 15*b*, is supported by the side wall 10*d* by means of a mounting piece 17*a* or 17*b* made of electrical insulating material such as poytetrafluoroethylene. The size of the casing 10, particularly of the inside thereof is given a certain size to have a predetermined cutoff frequency.

Figure 3:
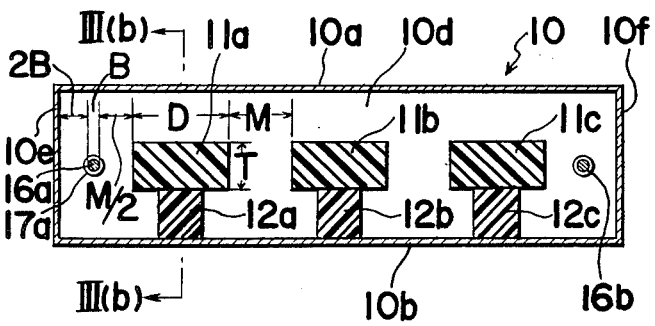
FIG. 3(*a*) is a sectional side view taken along the line III(*a*)–III(*a*) of FIG. 2.
Figure 3:
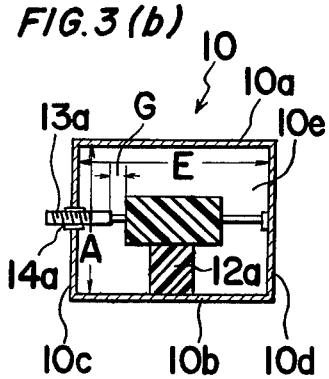

With particular reference to FIGS. 3 and 4, there are shown details of the microwave band-pass filter of the present invention. The description hereinbelow is particularly directed to the first resonator 11*a* provided at the leftmost end as viewed in FIG. 2. However it is to be noted that other resonators 11*b* and 11*c* are formed in the same manner and have the same structure as the resonator 11*a*. The dielectric resonator 11*a* is made of a cylindrical block of any known dielectric material. The size of the cylindrical block is such that the diameter D thereof is a few centimeters, for example, in one type 1.45cm, the thickness T thereof is about half the size of the diameter D and is determined by the resonance frequency. The resonator as described above is fixedly bonded onto the cylindrical supporting spacer 12*a* which is in turn fixedly bonded onto the bottom wall 10*b*. The height of the supporting spacer 12*a* is such that the center of the resonator 11*a* bonded onto the spacer 12*a* matches the center of the depth A of the casing 10. The inner dimensions of the casing 10 are such that the depth A is within a range of 2T to 3T, while the width E, corresponding with the direction in which the probes 16*a* and 16*b* extend, is within a range of 2D to 3D. The dimension measured in the longitudinal direction of the casing 10 is determined by the number of the resonators to be placed in the casing 10.

Still referring to FIG. 3, the three resonators 11*a*, 11*b* and 11*c* are spaced from each other a distance M which is normally within a range of D/2 to D, while the distance between the resonator 11*a* and the probe 16*a* and the distance between the resonator 11*c* and the probe 16*b* is M/2. Each of the probes 16*a* and 16*b* is spaced apart from the end walls 10*e* and 10*f*, respectively, at a distance within a range of B to 3B in which B is the diameter of the probe. It is to be noted that the axis of the probes 16*a* and 16*b* are in alignment with the center of the resonators.

Referring back to FIG. 2, the casing 10 is further provided with screws 13*a*, 13*b* and 13*c*, made of metal which are, respectively, threaded through threaded holes 14*a*, 14*b* and 14*c* provided in the front side wall 10*c*. The holes 14*a*, 14*b* and 14*c* are arranged at places approximately half the height of the side wall 10*c* and are spaced from each other a predetermined distance, so that the tip end of each of the screws is positioned closely adjacent the side surface of the resonator. Preferably, each of the screws has the tip end thereof aligned with the center of the respective resonator. A clearance G between the tip end of each of the screws and the surface of the respective resonators can be adjusted by turning the screws. Normally, the clearance G is adjusted so as to be not less than 0.3 mm.

It should be noted that the screws 13*a*, 13*b* and 13*c* described as made of metal can be made of dielectric material. In other words, the screws can be any type of material so long as the screws will influence the electric field or magnetic field formed in the casing.

The function of the foregoing screws 13*a*, 13*b* and 13*c* is described hereinbelow in connection with graphs shown in FIGS. 4(*a*) to 4(*e*).

When the microwave band-pass filter is constructed with dielectric resonators 11*a*, 11*b* and 11*c*, the dominant mode of resonance is $H_{01\delta}$ while the resonance frequency is, according to the embodiment of the present invention, determined to be $f_0$[GHz], for example, 7GHz. It is to be noted that the dominant mode as well as the resonance frequency may be changed by a change of size of the casing 10 and each of the resonators. In the case where the microwave band-pass filter is not provided with the adjusting screws, the wave form of the dominant mode $H_{01\delta}$ gradually drops down in frequency region between 7 and 8GHz. At the same time, there is produced a spurious mode $E_{11\delta}$ at frequency of $f_1$[GHz] which is, for example, approximately in the frequency region of 9GHz. By providing the screws 13*a*, 13*b* and 13*c* in respective screw holes, when the screws are of conductive material, they influence the electric field produced by the spurious mode, so that the spurious mode $E_{11\delta}$ is gradually shifted towards a lower frequency region where the dominant mode $H_{01\delta}$ exists, depending on the distance the screws extend into the casing 10. When each of the screws is threaded in to a position in which it occupies about a half the distance between the side wall 10*c* and the surface of the resonator, the wave form of the spurious mode $E_{11\delta}$ overlaps the wave form of the dominant mode $H_{01\delta}$ and deforms the wave form of the dominant mode $H_{01\delta}$, thus giving the wave form of the dominant mode $H_{01\delta}$ a shape as shown in FIG. 4(*c*). As is seen in FIG. 4(*c*), the wave form of the dominant mode $H_{01\delta}$ droops more rapidly than those wave forms shown in FIGS. 4(*a*) and 4(*b*).

When the screws are threaded further into the respective holes, the spurious mode $E_{11\delta}$ further moves towards a lower frequency region, for example to a region below 7GHz, whereupon the curve of the dominant mode $H_{01\delta}$ shows a further rapid drop in the region higher than 7GHz.

When the screws are threaded in so that the distance G is as small as 0.3mm, then, the spurious mode $E_{11\delta}$ is shifted to a region close to 6GHz, whereupon the curve of the dominant mode $H_{01\delta}$ substantially drops linearly in the region higher than 7GHz.

Accordingly, by providing a screw closely adjacent the side face of the resonators where there is produced a high intensity of electric field due to the spurious mode, the wave shape of the dominant mode in the higher frequency region thereof rapidly drops, so that it is possible to construct a microwave band-pass filter which operates with accuracy by a simple construction as described above at a comparatively low manufacturing cost.

Although the resonance frequency of the dominant mode may be shifted slightly above the predetermined frequency, in response to the insertion of the screws 13*a*, 13*b* and 13*c*, such shift in the resonance frequency can be simply corrected by any known correcting means such as correcting screws (not shown) provided above each of the resonators.

It is to be noted that the screws may be replaced with bars or rods made of conductive or dielectric material such as metal or synthetic resin. In this case the bars or rods are preferably arranged with means for adjusting the degree to which the bars or rods extend into the respective openings provided therefor in the casing.

It is also to be noted that the screws may be at positions which differ slightly from the above described position in relation to the resonator and yet achieve the same effect as described above. The amount of difference is described hereinbelow in connection with FIGS. 5 and 6.

Any one of the screws may be positioned, as shown in FIG. 5, with a range of positions in the longitudinal direction of the casing 10 which range D is equal to the diameter of the resonator, while, on the other hand, any one of the screws may be positioned, as shown in FIG. 6, within a range 2T of positions in the widthwise direction of the casing 10.

It is further to be noted that the adjusting screw described as having the tip end thereof located closely adjacent the dielectric resonator may be positioned to have the tip end thereof in contact with the dielectric resonator.

It is still further to be noted that the number of the adjusting screws is not limited to one, but it is possible to provide more than one adjusting screw for each of the dielectric resonators.

Figure 1:
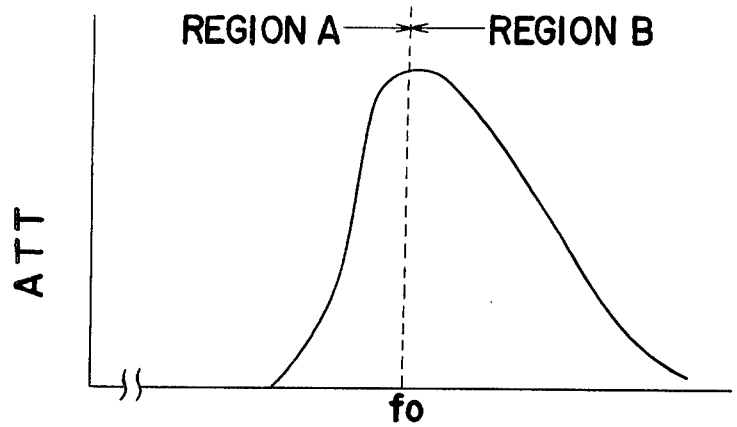

Although the present invention has been fully described by way of example in connection with a preferred embodiment thereof, it should be noted that various changes and modifications will be apparent to those skilled in the art. By way of example, the microwave band-pass filter of the present invention is not restricted only to the one described above, but other types of microwave band-pass filters such as microstrip filters and waveguide filters which employ dielectric resonators are construed as being included in the present invention. In employing dielectric resonators in other types of microwave band-pass filters such as a waveguide, the input and output for the microwave can be formed by merely providing openings at opposite ends of the filter instead of input and output terminal means such as the probes described above. In addition, even in the embodiment shown in FIG. 1, the adjusting screws may be modified to have any other form such as a plate form or a cylindrical form, and the adjusting screws may either be insulated from the casing 10 or electrically connected to the casing 10.

Therefore, these changes and modifications are to be understood as being included within the scope of the present invention unless they depart therefrom.

What is claimed is:

1. A microwave filter comprising;

an electrically shielded casing for forming a path for a microwave;

input and output means provided on said casing at opposite ends of said path;

at least one dielectric resonator disposed within said casing and positioned between said input and output means and in electrically insulated relation to said casing and in spaced relation from the internal surface of said casing and having top and bottom surfaces around which the electric field of the dominant mode of resonant vibration is high and having a side surface at which the electric field of a spurious mode of resonant vibration is concentrated; and at least one member provided adjacent and at the side of said dielectric resonator where the intensity of the electric field produced by said spurious mode is high for shifting the frequency of said spurious mode from a high frequency region to a low frequency region and overlapping said dominant mode with said spurious mode for improving the sensitivity characteristic of said dominant mode.

2. A microwave filter as claimed in claim 1, wherein said input and output means are input and output terminal members extending from the outside of said casing into the interior of said casing, said input and output terminal members having an inside portion within said interior of said casing and being separated from each other.

3. A microwave filter as claimed in claim 1, wherein said member is an adjusting screw member adjustably threaded through said casing and has one end within the casing situated adjacent the resonator.

4. A microwave filter as claimed in claim 3, wherein said adjusting screw member is made of conductive material.

5. A microwave filter as claimed in claim 3, wherein said adjusting screw member is made of dielectric material.

6. A microwave filter as claimed in claim 3, wherein said adjusting screw member has said one end aligned with the center of said dielectric resonator.

7. A microwave filter as claimed in claim 6, wherein said one end of said adjusting screw member is spaced a pedetermined distance from said dielectric resonator for leaving a clearance between said dielectric resonator and said one end of said screw member.

8. A microwave filter as claimed in claim 7, wherein said clearance is not less than 0.3 mm.

* * * * *